United States Patent [19]

Geiser

[11] 4,278,178

[45] Jul. 14, 1981

[54] CHILD-RESISTANT CLOSURE AND CONTAINER

[75] Inventor: Milton L. Geiser, Millersville, Pa.

[73] Assignee: Kerr Glass Manufacturing Corporation, Los Angeles, Calif.

[21] Appl. No.: 40,694

[22] Filed: May 21, 1979

[51] Int. Cl.[3] ..... B65D 55/02

[52] U.S. Cl. ..... 215/215; 215/224; 215/321

[58] Field of Search ..... 215/215, 224, 321; 220/284

[56] References Cited

U.S. PATENT DOCUMENTS

| | | | |
|---|---|---|---|
| 3,532,249 | 10/1970 | Gach | 220/284 |
| 3,828,959 | 8/1974 | Lerner | 215/215 |
| 4,124,134 | 11/1975 | Montgomery | 215/215 X |

*Primary Examiner*—George T. Hall

*Attorney, Agent, or Firm*—Fitch, Even, Tabin, Flannry & Welsh

[57] ABSTRACT

A child-resistant closure and container system is provided with a snap on and off closure requiring a coin or tool to remove the closure. A skirt wall on the closure is positioned sufficiently close to a shoulder on the container that the gap between the bottom edge of the skirt wall and adjacent shoulder is insufficient to admit a tool or to allow the teeth of a child to enter and to be used to pry off the closure. The shoulder diameter is equal to or greater than the diameter of the skirt wall to prevent the child's teeth from engaging and prying off the cap. A small notch is formed in the skirt wall to allow a coin or tool to be inserted and to be twisted against the shoulder to pry off the closure.

6 Claims, 5 Drawing Figures

CHILD-RESISTANT CLOSURE AND CONTAINER

STATEMENT OF FIELD

This invention relates to a child-resistant closure and container and, more specifically, to a container with a snap-on closure so designed that the closure can only be removed with a flat-edged tool inserted in a place so provided in the closure. This serves to prevent removal of the closure by small children lacking a tool and/or lacking the dexterity and strength to remove the closure from the container.

PROBLEMS OF ART AND PRIOR ART

Many products used for automotive purposes such as gasoline additives are very dangerous if consumed or otherwise exposed to children. Thus, a container closure assembly must provide a means for preventing removal of the closure by children and should be leak proof so that the child may not drink escaping liquid while the closure is still in place.

At the same time, a liquid closure must be removable by adults. While the combination of comprehension, dexterity and strength needed to remove the closure should be beyond that of young children, it is desirable that the removal be readily understood and convenient for use by adults. In this regard, it is desirable that the opening method be readily apparent to an adult and that it be accomplished with a readily available tool such as a screwdriver or a coin.

Furthermore, it is desirable that such a closure be made as cheaply as possible. Gas line additives, for example, are often inexpensive chemicals and a container which is to be disposed of after a single use should not add significantly to the cost. Some of the previous systems used child-resistant closures, but they were cumbersome and expensive to make or to assemble. Other closures, such as disclosed in U.S. Pat. No. 3,828,959, require a special tool or key to open which can be lost, thereby frustrating the user. It is desirable to avoid the added expense and inconvenience of a special key. It has also been found that if the bottom rim of the closure skirt wall is accessible to a child's teeth or fingers that the child may try to pry off the closure with his teeth. Thus, for example, U.S. Pat. No. 4,124,134 discloses a gap between the skirt wall's bottom edge and an adjacent shoulder on the container sufficient to receive a coin or a child's tooth. When considering the molding tolerances involved for a plastic closure and for a plastic container, this gap may be quite large in some instances.

BRIEF STATEMENT OF THE INVENTION

It has been found that a snap-on cap involving mating annular rings on the interior of the cap and exterior of the container spout can be made child-resistant by eliminating a prying edge accessible to small children. This is accomplished in the instant invention by making a spout of a bottle narrower than the neck and making the cap of less outside diameter than the neck while, at the same time, minimizing space between the skirt of the cap and the shoulder of the container.

The cap is removed by inserting and twisting a coin, screwdriver or other flat object in a slot defined by the shoulder of the container and a notch on the cap. The twisting required of the flat object both prys the cap while preventing rotation of the cap during prying.

When producing a container for liquids such as gas line additives, it is, of course, desirable that the contents do not leak either when sitting on shelves in a store or when being handled by children who may try to drink the leaking contents. For this reason, it is desirable to include in such a container-closure combination a seal which will remain intact under ordinary usage.

The instant invention provides a sealing element including a sealing portion which adheres to the lip of the container, seals the container and continues to seal the container even when the closure is moved or removed. The sealing portion must be punctured by a sharp object to allow removal of the liquid.

DETAILED DESCRIPTION OF THE DRAWINGS

Figure 1:
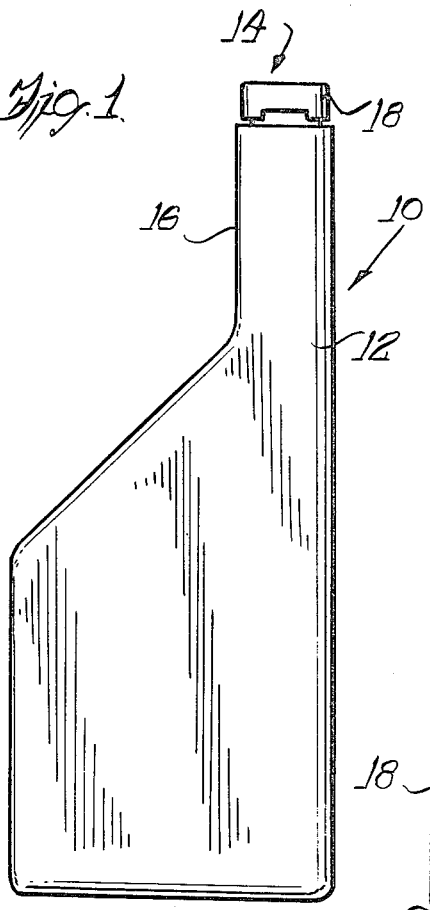
FIG. 1 shows a perspective view of a container and cap.
Figure 2:
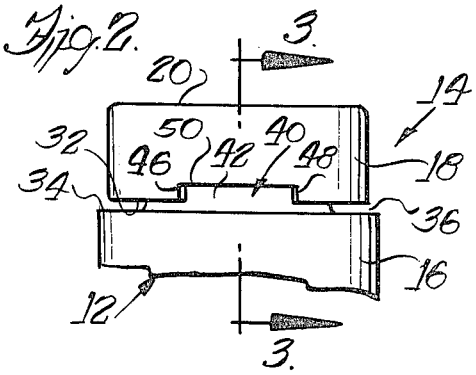
FIG. 2 shows an enlarged perspective of the cap on the end of the bottleneck.

Referring now to the drawings in greater detail, FIG. 1 shows a liquid package 10 comprising a hollow container 12 closed and sealed by a child-resistant closure or cap 14. The container 12 shown in this embodiment has a long narrow neck 16 designed to reach into gas tanks of automobiles requiring lead-free gasoline and may carry a liquid gasoline additive. Herein, the closure 14 is a small diameter closure having an annular skirt 18 depending from a top wall 20 disposed over an open mouth 22 for the container. The closure carries a separate sealing element 24 which is in sealing engagement with an annular lip 26 of the container mouth 22. The closure is of the snap-on and off type having an internal bead or rib 28 for sliding axially past a container rim or bead 30. A lower rim 32 is spaced from an adjoining annular shoulder wall 34 on the container.

It has been found that when a space or gap 36 between the bottom rim wall 32 and the shoulder wall 34 is sufficient to admit a coin that a child may use his pointy teeth at this gap and pry off the cap. However, if the gap is kept very small, then other manners must be employed to remove the closure 14. It will be appreciated that the sealing element liner 24, the plastic closure and plastic container finish involve considerable tolerances and that to keep the gap 36 smaller than a coin width, for example, 1/16 inch, in the worst case means that the gap must be kept very small for its nominal dimension. Of course, if the entire bottom edge 32 of the skirt is exposed or a finger portion protruding outwardly is available, then the children will try to pry the closure off with their teeth.

In accordance with the present invention, the closure 14 is made child-resistant by eliminating a prying rim edge accessible to the teeth of small children; and this is accomplished by making the skirt wall 18 of less outside diameter than the shoulder 34 while, at the same time, minimizing space 36 between the bottom edge 32 of the skirt and the shoulder 34 of the container. In order for a child to remove the closure, the child must find a tool and exert with sufficient manual dexterity a twisting action by a tool inserted into a slot 40 which is defined on one side by the shoulder 34 of the container and a notch 42 in the skirt wall 18. The twisting required of the tool pries the closure while preventing rotation of the closure during prying.

Referring now in greater detail to the illustrated embodiment of the invention, the notch 42 for receiving a tool 44 (FIG. 4) is formed with a limited arcuate extent to provide edges which stop the sliding of the tool along the shoulder 34 during the twisting operation. That is, when twisting the tool, if it begins to slide along the shoulder 48, it will slide only a very short distance before abutting a vertically extending end wall 46 or 48 formed at opposite ends of the notch 42. A top wall 50 extending circumferentially between the end walls 46 and 48 defines the upper side of the notch and is engaged by the tool when snapping the closure off, as best seen in FIG. 4.

Figure 4:
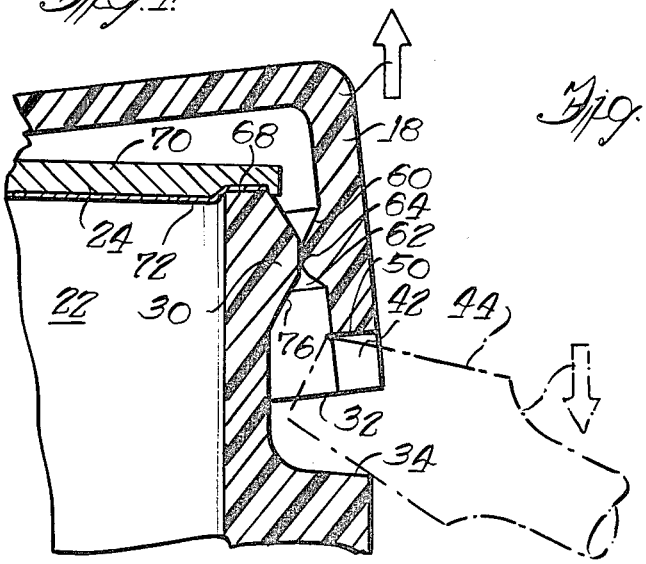
FIG. 4 shows a partial cross-sectional view of the cap being pried from the bottleneck.
Figure 5:
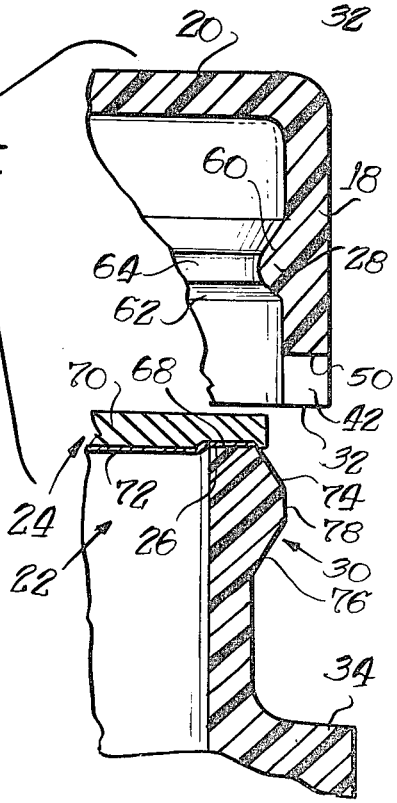
FIG. 5 shows partial cross-sectional views of the cap removed from the bottleneck.

The illustrated cap is formed of a flexible material which is sufficiently rigid that it cannot be readily bent to the snap-off position, shown in FIG. 4, by the fingers of a child. One such plastic material is a high density polyethylene. Preferably, the closure is made by injection molding techniques with the slot 42 being molded therein. The illustrated closure is very small, e.g., having an outer diameter dimension of 0.867 inch and a height of about 0.325 inch. The thickness of skirt wall 18 is about 0.050 inch, in this instance, exclusive of the bead thickness. Herein, the bead adds about 0.028 inch to the skirt wall thickness. The circumferential extent of the pry slot 42 is 55° in this instance, with a height of about 0.060 inch. The size of the pry off slot 42 is dimensioned to admit a quarter and an automotive key, the usual tools an adult will have available to him. The quarter can be inserted sufficiently in the slot to give the desired leverage to snap off the cap. The preferred top wall 20 is about 0.050 inch thick. Manifestly, the dimensions given herein are by way of example only and other dimensions may be used and fall within the purview of the appended claims.

To facilitate the pushing of the closure 14 onto the container 10 by automated machines and the removal of the closure without requiring undue force, both the container bead 30 and the closure bead 28 are formed with upper and lower camming surfaces which are inclined to slide past each other while flexing outwardly the flexible skirt wall 18. Herein, the closure bead 28 has an upper camming wall 60 which is at 30° to the vertical and a lower camming wall 62 which is 45° to the vertical. The preferred annular apex wall 64 is rounded with a 0.030 inch radius in this instance to facilitate its sliding past the container bead and has a minimum diameter of 0.711 inch.

The closure upper camming wall 60 having a 30° slope abuts the lower camming surface 76 of the container which has a different angle to provide a mismatch and a better seal therebetween. That is, the lower container camming surface 76 is at a 35° angle to the vertical and should provide a continuous ring of contact with the closure upper camming wall 60. This should provide a secondary seal.

It is preferred that the sealing element 24 remains adhered to and in sealing engagement with rim surface 68 of the container mouth 22. The preferred sealing element 24 includes an upper resilient pad 70 of paperboard material to which is laminated a metallic foil sealing disc 72 which bonds to a lip of the spout. The sealing disc 72 in this embodiment is adhered to the lip 68 in an automatic manner when heat is applied thereto by a capping machine in a known manner. The preferred foil has a thin film layer of adhesive thereon which when heated and pushed against the plastic rim causes the adhesion. The capping machine has an induction heater therein and applies the closure with 30–40# of force to snap closure onto container. The sealing disc remains sealed to the lip even when the cap 14 is removed from said container 12. The sealing element 24 is retained above the closure bead 28 because it has a larger diameter than the bead diameter and is pushed therepast into the space above the bead.

Figure 3:
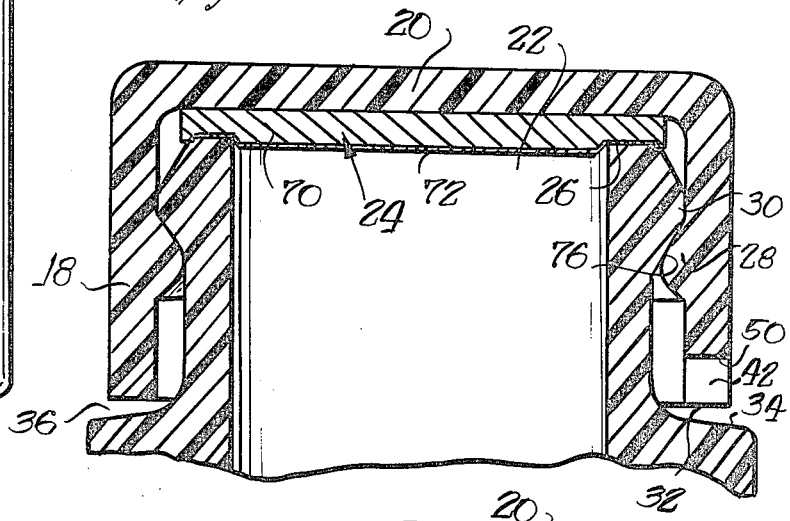
FIG. 3 shows a cross-sectional view of the cap on the bottleneck.

The illustrated container 12 has its retaining bead 30 formed with upper and lower camming surfaces 74 and 76 which are inclined at about 30° to the vertical. A central annular apex wall 78 is provided between the upper and lower camming surfaces 74 and 76 and this wall abuts the interior surface of the skirt wall 18, as best seen in FIG. 3, when the closure is applied. In this applied position, the inclined bead walls 60 and 76 on the closure and container are abutted and the top end wall 20 is being biased down against the sealing element 24 to assist in holding same tightly against the container rim 68. The distance of the closure bead surface 60 from the top end wall 20 and the distance of the container bead surface 76 from the rim 68 are chosen to maintain the closure biased to its closed position and to position the bottom wall 32 of the skirt closely adjacent the annular shoulder 34, i.e., at a distance of 0.030 or less. In the illustrated embodiment, this space is 0.025 plus or minus 0.015 inch. As shown herein, the outer diameter of the shoulder 34 is slightly greater than the 0.867 inch diameter of the skirt wall so that a child may not bite the bottom wall and pry the closure off with his teeth. The shoulder maximum diameter here is kept very small so that the container neck 16 may also enter into the gas tank opening.

From the foregoing, it will be seen that the present invention provides a new and improved child-resistant package having a closure which cannot be readily pried off by a child's teeth but which can be snapped off with a coin or other tool. The closure includes a laminated sealing element having a foil layer heat sealed to the container.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. The combination of a plastic container and a pry-off closure therefor comprising:

a container having a body with an upstanding neck, an annular shoulder of a predetermined diameter on the neck of the container and having a continuous uninterrupted planar surface, an upstanding annular pouring spout on said container projecting upwardly from said shoulder and terminating in an upper rim about a container opening, means defining a retaining ring means on said spout adjacent the upper rim for cooperation with the closure, a closure for said container made of plastic and having a predetermined flexibility, a top wall on said closure, an annular depending skirt wall integrally formed with said top wall and having a diameter equal to or less than said predetermined diameter of said shoulder, said skirt wall having an outer cylindrical surface without any projections for prying off of said cap, an inwardly projecting ring means on the internal wall of said closure for engaging said retaining ring means and for snapping thereover to secure said closure to said container, said inner wall of said closure has a cylindrical surface without any projections thereon other than said inwardly projecting ring means, allowing said closure to turn to any rotative position relative to said container, a discrete sealing element disposed beneath said top wall and having a portion for sealing with and adhering to the rim of said container to seal the same with removal of the closure from the container, said sealing element being separable from said closure after being adhered to said container rim;

a bottom end wall on said skirt disposed closely adjacent to said continuous, uninterrupted planar surface on said shoulder at a predetermined spacing, and walls in said skirt defining a slot extending upwardly from said bottom end wall of said skirt to adjacent said inwardly projecting ring means providing a spacing greater than said predetermined spacing with said shoulder to receive a coin or tool therein for flexing the skirt wall for prying off said closure from said container, said slot being sufficiently wide to admit a coin into the slot in wedging relationship when said closure is in rotative position relative to said container.

2. The combination in accordance with claim 1 in which the external diameter of said skirt wall and the external diameter of said shoulder are substantially the same.

3. A combination in accordance with claim 1 in which the maximum spacing between said bottom skirt wall and said shoulder is about 3/64 inch.

4. A combination in accordance with claim 1 in which said walls in said skirt defining said slot comprise a pair of vertical end walls and an arcuately extending top wall therebetween.

5. A pry-off closure for use with a container having a mouth with a lip and an annular retaining ring below the lip, said closure comprising:

a closure for said container made of plastic and having a predetermined flexibility, a top wall on said closure, an annular depending skirt wall integrally formed with said top wall, said skirt wall having an outer cylindrical surface without any projections for prying off of said cap, an annular ring on the internal wall of said closure for engaging said retaining ring on said container and for snapping thereover to secure said closure to the container and to establish a seal with the container sealing ring, said inner wall of said closure has a cylindrical surface without any projections thereon other than said inwardly projecting ring means, allowing said closure to turn to any rotative position relative said container, a discrete sealing element disposed beneath said top wall and having an adhesive thereon for adhering to the lip of the container to seal the same with removal of the closure from the container, said sealing element being separable from said closure after being adhered to said container rim;

a bottom end wall on said skirt being substantially continuous except for a slot therein, and walls in said skirt defining the slot in a bottom end wall of the skirt with the slot having a height of less than $\frac{1}{8}$ inch and an arcuate extent of about 55°, said slot being positioned beneath said annular ring.

6. The combination in accordance with claim 5 in which the external diameter of said skirt wall is less than one inch and the height of said closure is less than $\frac{1}{2}$ inch.

* * * * *